US008440159B2

(12) United States Patent
Brucher et al.

(10) Patent No.: US 8,440,159 B2
(45) Date of Patent: May 14, 2013

(54) METHOD FOR EXTRACTING AMMONIUM SALT AND METHANOL FROM A LIQUID OBTAINED FROM FOUL CONDENSATES IN A CELLULOSE PULP MILL

(75) Inventors: Jorg Brucher, Domsjo (SE); Anders Johan Norberg, Ornskoldsvik (SE)

(73) Assignee: Metso Power AB, Gothenburg (SE)

( * ) Notice: Subject to any disclaimer, the term of this patent is extended or adjusted under 35 U.S.C. 154(b) by 37 days.

(21) Appl. No.: 12/744,479

(22) PCT Filed: Nov. 26, 2008

(86) PCT No.: PCT/SE2008/051358

§ 371 (c)(1),
(2), (4) Date: Sep. 2, 2010

(87) PCT Pub. No.: WO2009/070110

PCT Pub. Date: Jun. 4, 2009

(65) Prior Publication Data

US 2010/0316553 A1 Dec. 16, 2010

(30) Foreign Application Priority Data

Nov. 26, 2007 (SE) ..... 0702610

(51) Int. Cl.

| | |
|---|---|
| ***C01B 21/20*** | (2006.01) |
| ***C01C 1/18*** | (2006.01) |
| ***D21C 3/20*** | (2006.01) |

(52) U.S. Cl.
USPC ..... 423/545; 423/388; 423/396; 162/76

(58) Field of Classification Search ..... None
See application file for complete search history.

(56) References Cited

U.S. PATENT DOCUMENTS

| | | | | |
|---|---|---|---|---|
| 3,920,717 | A * | 11/1975 | Marion | 518/703 |
| 5,779,861 | A * | 7/1998 | Holiday et al. | 203/11 |
| 7,632,479 | B2 * | 12/2009 | Curren et al. | 423/356 |
| 2004/0108085 | A1 * | 6/2004 | Kettenbach et al. | 162/55 |
| 2006/0137867 | A1 * | 6/2006 | Hayashi et al. | 165/158 |
| 2007/0090057 | A1 * | 4/2007 | Burckle et al. | 210/722 |

FOREIGN PATENT DOCUMENTS

WO WO 9937853 * 7/1999

* cited by examiner

*Primary Examiner* — Melvin C Mayes
*Assistant Examiner* — Sheng H Davis
(74) *Attorney, Agent, or Firm* — Rolf Fasth; Fasth Law Offices

(57) ABSTRACT

Desirable chemicals are recovered from a raw material that is formed in substantial amounts during the production of cellulose pulp from renewable lingo-cellulose material. An ammonia/ammonium-containing methanol/water mixture is acidified with an acid that has the ability of forming ammonium salt with the ammonium. The mixture is circulated and passed through an apparatus that has an indirect heat exchanger combined with an storage volume fitted with a gas collection device.

20 Claims, 1 Drawing Sheet

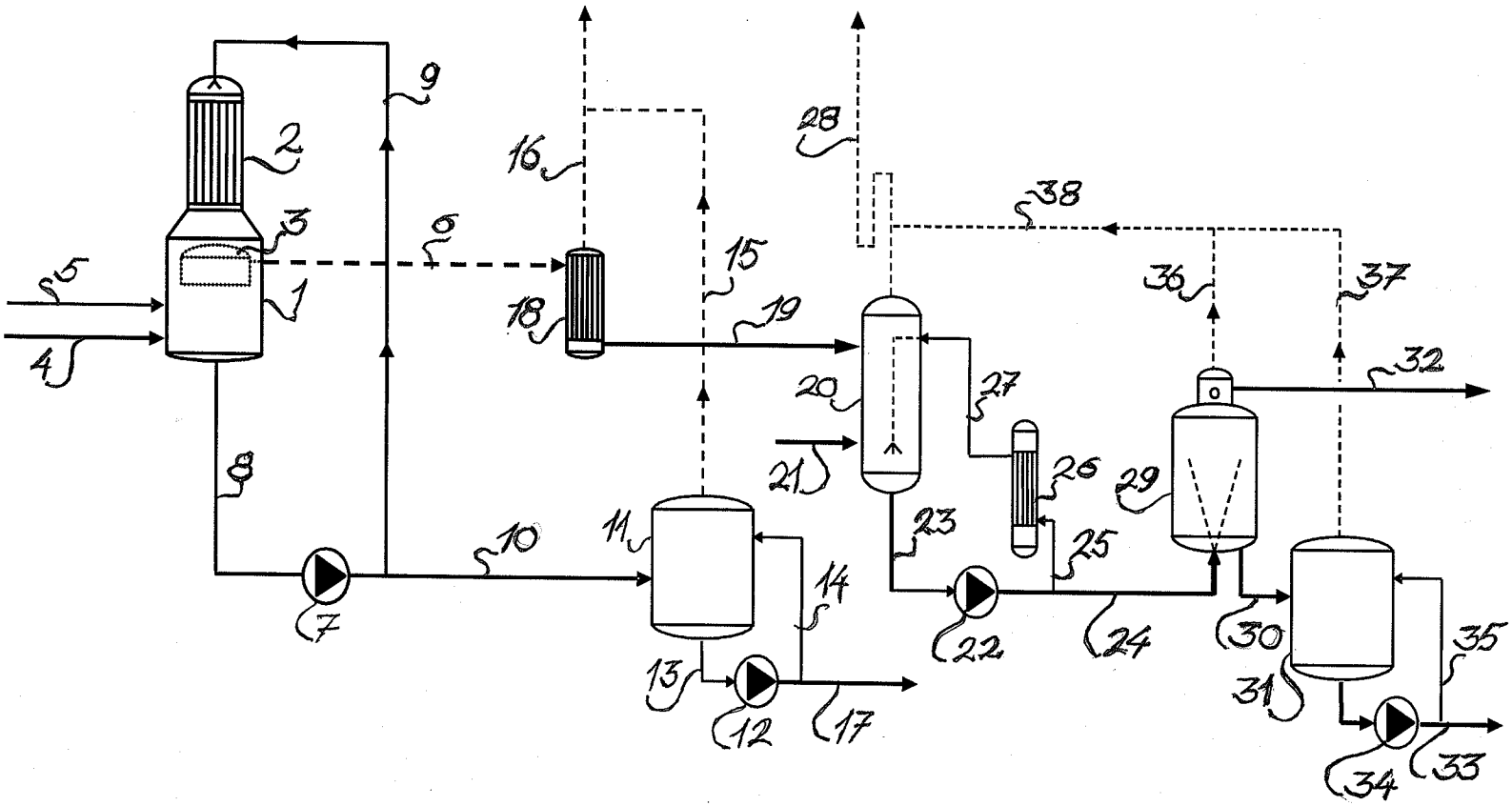
1
2
3
4
5
6
7
8
9
10
11
12
13
14
15
16
17
18
19
20
21
22
23
24
25
26
27
28
29
30
31
32
33
34
35
36
37
38

METHOD FOR EXTRACTING AMMONIUM SALT AND METHANOL FROM A LIQUID OBTAINED FROM FOUL CONDENSATES IN A CELLULOSE PULP MILL

PRIOR APPLICATION

This application is a U.S. national phase application based on International Application No. PCT/SE2008/051358, filed 26 Nov. 2008.

BACKGROUND AND SUMMARY OF THE INVENTION

Technical Field

The present invention relates to a method for extracting highly purified chemicals in the form of ammonium salt, for example ammonium sulphate, and methanol from a liquid derived from a secondary condensate and wherein the secondary condensate in turn has been obtained by stripping a contaminated primary condensate resulting from the production of cellulose pulp, said cellulose pulp being produced completely or partly by the delignification of lignocellulose material of different kinds, normally wood from coniferous and/or deciduous trees, with the use of an alkaline cooking liquor.

There are a number of different alkaline methods of delignification (cooking). The most commonly used alkaline method (by tonnage) in the world is the sulphate process, which also includes the polysulphide process. There are sulphate processes of slightly different kinds. Variations may be, for example, the use of high sulphidity $$\frac{Na_2S}{Na_2S + NaOH},$$

or counter-current cooking, i.e. where white liquor is added also during an advanced stage in the cooking process, or performing a chemical treatment of the lignocellulose material prior to the actual sulphate cooking. Another less frequently used alkaline method of delignification is the soda (sodium hydroxide) process, wherein catalysts, such as a quinone compound, are added to the cooking liquor. A third alkaline method of delignification is the alkaline sulphite process, where the pH of the cooking liquor can be up to 10. During the production of semi chemical pulp, a delignification step is followed by a mechanical fibre separation step. In the delignification step, alkaline cooking liquor with varying alkalinity may be used. An example of such cellulose pulp is a pulp called NSSC (Neutral Sulphite Semi-Chemical). In this case the alkalinity of the cooking liquors is low, if it is even detectable.

The delignification of the lignocellulose material takes place under pressure, resulting in, after delignification, expulsion from the delignification vessel (the cooker) of waste liquor and, from the waste liquor, an emitted gas mixture, comprised of water vapour and organic and inorganic chemical compounds. During conventional batch-wise delignification, the waste liquor leaves the cooker together with the resultant pulp, or as in the RDH or Superbatch technique, the waste liquor is displaced from the cooker in a displacement process with wash liquors. Said gas mixture is made to condense and a so called cooking condensate is formed. Such gas mixtures are also released, and are collected, in other places in the digester house than in the cooker itself, and are then made to condense, which is why they are called cooking condensates instead of just blow steam condensate. Said condensate is formed both during batch-wise and continuous delignification of lignocellulose material. After delignification of the lignocellulose material the cooking waste liquor is separated from the resulting cellulose pulp, and this cooking waste liquor (nowadays normally mixed with bleach plant waste liquor), normally called black liquor, is evaporated prior to this liquor, in the form of condensed waste liquor, being burned, for example in a soda ash furnace. Even during the multiple-effect evaporation of the black liquor, gas mixtures similar to the one described above, are expelled from the black liquor. These gas mixtures are made to condense and a so called evaporation condensate, which is mainly water, is produced.

The amount of condensate formed is so large that it has to be handled and purified in a way that will make it possible to reuse the purified condensate in the production of cellulose pulp. Manufacturers of cellulose pulp are constantly trying to minimize the use of fresh water and it is therefore extremely important that the condensate is reused in purified form. The evaporation condensate obtained from some effects can be sufficiently pure that it may be reused directly in some tolerant stage of the pulp production process, but the main part of the evaporation condensate obtained is contaminated to such an extent that it must be cleaned.

The most common way to clean contaminated condensate, which may come from the digester house, bleachery or from the evaporation, is by so called stripping, which means that water vapour or heated air (not common), i.e. a gas, flows through the condensate in the form of a liquid column. In this way a large number of compounds are expelled from the contaminated condensate in vapour form and these vapours are later made to condense to produce a liquor.

This liquor is the basis and starting material for the recovery of the chemicals according to the present invention and it will herein be called a primary condensate. This liquor, or primary condensate, mainly comprises the chemical methanol=$CH_3$.OH. The weight percent of methanol normally exceeds 60. The rest of the liquor is mainly water. The water contains dissolved nitrogen compounds in the form of the ammonium ion $NH_4$+ and ammonia $NH_3$. The liquor normally also comprises a small amount of turpentine. It also contains volatile malodorous sulphur-containing substances.

The Swedish patent publication 511 262 (9800190-2) discloses a method for reprocessing of the condensate formed during the production of cellulose pulp using alkaline delignification. The method is characterized by the addition of acid to the condensate prior to stripping to lower its pH value to 5 7.5, which leads to the retention of the majority of the original nitrogen content of the condensate, and that after the stripping treatment, the stripper gases are taken care of in a conventional manner, and purified nitrogen rich condensate is transferred to a consumer position.

Lowering the pH value of the condensate converts dissolved ammonia in the condensate into ammonium ions ($NH_4^+$), which mainly stay in the condensate during stripping. All or part of the cleaned nitrogen-rich condensate may be transferred to any consumer position. Preferably the condensate is transferred to a place where the nitrogen may be used, for example to a biological sewage treatment plant within the sulphate pulp mill in question, which may be associated with a paper mill.

The disclosed method has a number of advantages. For example, the emission of nitrogen oxide is prevented during the combustion of the nitrogen-rich stripper gases and/or nitrogen-rich methanol derived from contaminated condensates. This is primarily important from an environmental standpoint. If a fee is levied for the emission of nitrogen oxides there is the added benefit of decreasing the cost of the cellulose pulp production process (to a certain extent). In cases where the purified nitrogen rich condensate may be put to good specific uses, such as the biological treatment of sewage with a nitrogen deficit, this can constitute an additional benefit.

Nevertheless, the disclosed method also has weaknesses and shortcomings. For example, all the contaminated condensate from the pulp mill must be acidified, which leads to the use of a large amount of acid. In the case where the purified nitrogen rich condensate is not transferred to a consumer position where the nitrogen is consumed, for example biological purification, but is instead transferred to another position in the production process of cellulose pulp, this will lead to a nitrogen enrichment at this stage. Selling the purified nitrogen-rich condensate on the open market is not possible for a number of reasons, partly because the condensate comprises water to such a high extent and partly because, if the condensate is removed from the cellulose pulp production process, the amount of fluid (mainly water) has to be replaced with water, such as fresh water, and also because the liquor has an unpleasant odour.

The Swedish patent publication 524 106 (9903676-8) discloses a method that to a certain extent corresponds to the method disclosed above, and in that extent demonstrates the same disadvantages as the above described method.

FIGS. 2, 3 and 4 in that patent publication demonstrates how the acid is added to the condensate during stripping (in a similar manner as in the first mentioned patent) and also how acid is added to the methanol column.

The patent has been granted for a method for the production of sulphate pulp where emission of $NO_x$ is reduced during processing, and a fluid stream of ammonia in enriched form is obtained, wherein the method comprises condensate purification with the use of a stripper and a methanol column, and wherein a volatile fraction comprising methanol is produced during the condensate purification, the method being characterized by the addition of an acidifier to the methanol column.

In the first paragraph on page 2 in the Swedish patent publication 524 106 it is mentioned that the flow from the methanol column corresponds to about 1% of the flow out of the stripper. By adding the acid to the methanol column, instead of into or prior to the stripper, the amount of acid used is significantly reduced and a much higher concentration of ammonium salt is obtained in the fluid stream flowing from the methanol column than in the fluid stream (purified condensate) leaving the stripper.

This patent focuses on reducing the emission of $NO_x$ (nitrogen oxides) from sulphate pulp plants. The patent publication discloses that the object of the invention is to prevent ammonia from ending up in the methanol. In this way emissions of $NO_x$ from the pulp plant may be significantly reduced. This implies that the inventors intend the recovered methanol to be burned either in a soda ash furnace or a lime sludge reburning kiln. This method comprises the steps of direct heating with steam, which dilutes out the ammonia-rich solution from the methanol column. All the water in the expelled methanol steam is condensed in a first condenser and is transferred back to the solution in the methanol column and the methanol is consequently condensed out into a second condenser. In this case, the salting-out effect created from the establishment of a high content of ammonium salt is not taken advantage of.

This demonstrates that at the time of invention the inventors did not envisage how to control the process so that an ammonium salt and methanol could be recovered in high concentration and purity. A prerequisite for these chemicals to have a market value is that their concentration and purity is high enough.

Both ammonium salts and methanol of high purity are, as is evident from the previous disclosure, marketable commodities. The problems that must be solved are how to extract these chemicals from the disclosed methanol/water mixture in a way that makes the concentration and purity of the chemicals high enough, and to accomplish this in a cost effective manner.

Another problem is how to reduce the need for acidifying agents and how to significantly reduce the amount of acid fluid streams in the pulp mill.

Yet another problem is how to improve the efficiency of the expulsion of methanol from the secondary condensate by re-circulating the acidified secondary condensate to maintain the concentration of ammonium salt near the level where the ammonium salt is precipitated, which will create a polar solution leading to expulsion of the methanol, i.e. a salting-out effect.

The present invention solves these problems, and relates to a method for extracting highly purified ammonium salt and highly purified methanol from a secondary condensate comprising an ammonia/ammonium-containing methanol/water mixture, derived from stripping a contaminated primary condensate derived from a digestion house during the process of delignification of lignocellulose material to cellulose pulp with an alkaline cooking liquor and/or from the evaporation of cooking waste liquor. The invention comprises the steps of acidifying the secondary condensate with an acid that has the capacity to form an ammonium salt with the ammonium present in the secondary condensate and subjecting the mixture of secondary condensate and acid to heating so that methanol and volatile sulphur containing substances are expelled in gas form and transferred to a condenser, where the methanol is made to condense, while the volatile sulphur-containing substances remain in gas form, whereafter the liquid phase and the gas phase are separately removed from the condenser.

The invention is characterized in that the mixture, after the addition of acid, is made to circulate and, during circulation, the mixture is subjected to heat to reach a temperature above the boiling point of the methanol, but below the boiling point of both the added acid and water, preferably within the range of 70-105° C., wherein the re-circulation flow is at least 2-15 fold more than the inflow of secondary condensate. Furthermore, the circulating ammonium salt-containing mixture is then passed through an apparatus comprising an indirect heat exchanger combined with an storage volume fitted with a gas collection device, with the net inflow of water via the secondary condensate and the added acid being such that a concentration of ammonium salt is maintained at 1-20%, preferably 1-10%, below the level where ammonium salt is precipitated, and where the circulation optimizes the expulsion of the methanol and the volatile sulphur-containing substances from the mixture. The invention is further characterized in that 5-50%, preferably 10-40%, of the circulating mixture is withdrawn from the re-circulation flow in which the proportion of water has been increased by at least 2-5 fold compared to the proportion of water in the incoming secondary condensate, for collection in a container, and in that this mixture with a high water content is stirred and/or circulated to expel at least 80% of the remaining methanol and to expel at least 95% of the remaining volatile sulphur-containing substances. An oxidizing agent is then added to the recovered liquid methanol to convert liquid soluble malodorous sulphur-containing substances to mainly odourless substances.

It has previously been disclosed in this patent application how the starting material, i.e. the ammonia/ammonium-containing methanol/water mixture for recovery of the present chemicals is obtained.

This is done, as is evident, by purifying contaminated condensate, i.e. subjecting it to stripping, leading to the expulsion, in gas form, of methanol, water, volatile sulphur-containing substances, ammonia and turpentine and then condensing these gases to the liquor that is the starting material for the production of the present chemicals. This reduces the amount of condensate to be processed by 80-90%.

The contaminated condensate is derived from different alkaline methods for the production of cellulose pulp. The predominant alkaline method in the world is the sulphate process, and consequently the raw material for the method of the present invention is most commonly produced during the production of sulphate pulp.

The raw material must be acidified in order for an ammonium salt to form. Which ammonium salt is formed depends on which acid is added. Suitable acids are, for example, sulphuric acid (preferred), hydrochloric acid, nitric acid and phosphoric acid. The acidified secondary condensate is heated to above the boiling point for methanol, which is 65° C., but not above the boiling point for the added acid or the boiling point of water, which is 100° C.

The preferred sulphuric acid has a boiling point of 337° C., whereby this, by a wide margin, escapes vaporization if the acidified secondary condensate is heated to a temperature in the range of 70-95° C., within which temperature range water is not boiled off either, but remains in the circulating mixture.

As the concentration of ammonium salt increases at the start of circulation, the boiling point of the water also increases by a few degrees, which makes it possible to heat the acidified secondary condensate to a temperature in the range of 70-105° C. without boiling off the water.

Another effect of the increasing concentration of ammonium salt is that the solubility of methanol decreases with an increase in ion content, a so called salting-out effect, which facilitates the expulsion of methanol. For an improved expulsion of the methanol the concentration of ammonium salt should be maintained at 1-20%, preferably 1-10%, below the level where ammonium salt is precipitated. This precipitation level is easily identified by the solution becoming cloudy.

For hydrochloric acid, nitric acid and phosphoric acid, with boiling points of 108° C., 86° C. and 213° C., respectively, the heating temperature is adjusted so that the boiling point of the acid in question is not exceeded. For these acids the upper temperature may correspond to 90° C. (hydrochloric acid: range 70-90° C.), 80° C. (nitric acid: range 70-80° C.) or 105° C. (phosphoric acid: range 70-105° C.), respectively.

Organic acids may also be used, such as for example, acetic acid and formic acid. These acids however have lower boiling points of 118° C. and 110.8° C., respectively. The acidification may also be performed by addition of the gases carbon dioxide and sulphur dioxide. When these gases dissolve in water, carbonic acid and sulphurous acid, respectively, are formed, where the latter has a conveniently high boiling point of 445° C. The acidification may also be accomplished by adding hydrogen sulphite solution or a residual solution from the production of carbon dioxide or an acid bleach plant waste liquor.

In the case when acidification is carried out by the use of the preferred sulphuric acid, the salt formed is ammonium sulphate.

When the raw material is acidified, the resulting pH value of the water phase in the mixture is between 2 and 6.5.

The previously disclosed condenser contains a liquid phase which almost exclusively comprises methanol and a remaining gas phase which is predominantly volatile sulphur-containing substances. These are strongly malodorous. Such substances are, for example, methane thiol, dimethyl sulphide and dimethyl disulphide. Partly because the substances are malodorous they must be dealt with and preferably destroyed in some way. This gas phase is preferably transferred to a destruction facility of any known type.

The types of gases mentioned are also expelled at another stage in the chemical recovery process, more specifically from the ammonium salt-containing water solution which is withdrawn from the circulation tube and collected in a container. By stirring this water solution, for example, and/or circulating it, the remaining volatile sulphur-containing substances are almost completely expelled from the water solution; in relative terms at least 95% of these remaining substances are expelled. At the same time the bulk of the remaining methanol is expelled from the water solution. This gas mixture is also transferred to the destruction facility, either directly or after being mixed with the previously mentioned gas phase. Said expulsion determines the purity of the recovered and marketable ammonium salt, for example ammonium sulphate. If the expulsion of said substances is found to be too difficult, said stirring and/or circulation may be supplemented by adding a gas to the water solution. The gas travels up through a part of or all of the water.

The liquid methanol recovered from the condenser contains dissolved, malodorous sulphur-containing substances. Such substances are, for example, methane thiol, dimethyl sulphide and dimethyl disulphide. These substances must be neutralized to make the methanol acceptable on the market. One way to neutralize these substances is to oxidize them so that they are converted to an odourless form. Any known oxidizing agent may be used. A preferred type of oxidizing agent is peroxide and of the peroxides the most suitable is hydrogen peroxide. The amount of peroxide to be added to the methanol-containing liquid depends on the amount of said malodorous substances in each case, normally within the range of 0.5-5% by weight. There is a risk that all of the added peroxide will not be reacted and/or that a part of the added peroxide will react with some substance to form an organic peroxide. Due to the fact that peroxides are reactive and sometimes also explosive, any remaining peroxide must be removed from the methanol. This is done by adding a peroxide degrading catalyst to the oxidation treated methanol, with the development of oxygen gas, or by using a reducing agent. A suitable catalyst is, for example, an iron salt. Both iron (II) and iron (III) salts may be used, the latter salt being preferred. Reducing agents are, for example, sulphite and hydrogen sulphite.

Before the methanol is transferred to a storage tank it is in most cases necessary to let it pass through a decanter where any turpentine present is removed.

By using the method according to the present invention it is possible to produce methanol with a purity over 70%, and an ammonium salt, for example ammonium sulphate, with a purity over 30%. The remainder of the liquor, in each case, is comprised mostly of water. The amount of malodorous substances in the recovered methanol is generally not detectable and is typically lower than 0.1 mg/liter.

The amount of malodorous substances in the recovered ammonium salt is typically lower than 10 mg/liter.

By sequestering the nitrogen (in the form of an ammonium salt) in the said raw material it is possible, using conventional techniques in a cellulose pulp mill, to prevent emissions of $NO_x$ from the combustion of nitrogen-containing methanol. Emission of $NO_x$ is an environmental problem and it is therefore often subject to the levying of fees in many countries, including Sweden, where these emissions are currently charged at a fee of 50,000 SEK per ton $NO_x$. The method according to the present invention shares the advantage of sequestering nitrogen with a number of other methods; methods which are simply regarded as methods of purification.

The number of uses for highly purified methanol is increasing. The methanol may be used on site, i.e. within the cellulose pulp mill, as a substitute for mineral oil, which is used as a backup fuel or for other types of combustion to generate energy. The methanol may be used as engine fuel and it is also a key component in the production of other environmentally friendly engine fuels such as, for example, biodiesel, rapeseed oil methyl esther (RME). This methanol, derived from bio-pulp and more specifically lignocellulose material, has a number of uses as an alternative to and as a substitute for the methanol synthetized from fossil methane. Fossil chemicals, as is well known, are not derived from renewable sources.

There are also many uses for ammonium salt. One important use is as a fertilizer. In many fertilizers the source of the nitrogen is comprised of a mixture of nitrate ($NO_3-$) and ammonium ($NH_4+$). The ammonium component may be comprised of the ammonium recovered according to the present invention, in form of an ammonium salt. The ammonium salt may also be used as a fertilizer by itself. During the production of cellulose pulp it is an aim to reduce, as much as possible, the amount of nitrogen oxides that are emitted together with smoke gasses from furnaces of different types, for example from the soda ash furnace. What is done is that the nitrogen oxides are converted to inert nitrogen. Ammonium salt may also be used in a well known catalytic method of purification.

BRIEF DESCRIPTION OF THE DRAWING

FIG. 1 shows a flow chart where raw material is introduced from the left and thereafter is reprocessed in two steps, leading to the recovery of two condensed and highly purified chemicals.

DETAILED DESCRIPTION

A preferred embodiment of the method according to the present invention is described below, with reference to the flow chart in FIG. 1. Certain steps of the method are also described in more detail. Finally, two examples of embodiments of the present invention are disclosed, where the method according to the invention has been simulated in a laboratory.

FIG. 1 shows a storage volume 1 combined with an indirect heat exchanger 2. (Objects 1 and 2 may naturally be arranged at a distance from each other, provided that they are connected). In the storage volume 1, there is a steam bonnet 3. The raw material is transferred via tube 4 to the storage volume 1, in the form of a secondary condensate, i.e. the ammonia/ammonium-containing methanol/water mixture, which in turn has been derived from the stripping of contaminated primary condensate. Methanol predominates in the mixture, and is more than 60% by weight, and typically methanol comprises over 75% of the mixture by weight. This amount will vary depending on where the raw material comes from, i.e. from which pulp manufacturing process the raw material has been obtained, and even if the same pulp production process is used, for example the sulphate process, the content may vary between mills. The nitrogen component of the raw material exists partly as dissolved ammonia ($NO_3$) in the mixture, and partly as ammonium ions ($NH_4+$). The nitrogen present in the form of ammonia is greater the more basic the raw material is, i.e. the higher the pH value, and vice versa with lower pH values.

An acidic water solution is also transferred to the storage volume 1 via tube 5. The level of liquid in the storage volume 1 is just under the lower edge of the steam bonnet 3. This makes it possible to collect gases inside the steam bonnet 3. Bringing the two above mentioned fluid streams together before these meet in the storage volume 1 should be avoided. If these fluid streams are brought together prematurely, some of the newly formed ammonium salt will precipitate in solid form because the amount of water in the mixture is too low. The salt crystals formed may clog the apparatus. During operation, the ratio of methanol to water changes drastically inside the storage volume 1 because the main part of the fluid methanol in the incoming raw material/secondary condensate, as a consequence of the steps disclosed below, is converted to gas, which is collected in the steam bonnet 3 and is removed from the storage volume 1 via tube 6. From having been a lesser part of the secondary condensate, water is now predominant in the mixture in the storage volume 1. The water content often exceeds 75 percent by weight during operation. This large amount of water in turn has the capacity to hold in solution all of the ammonium salt formed.

The ammonium salt-containing mixture is withdrawn from the storage volume 1 and is made to circulate via tubes 8 and 9 to the top of the combined apparatus (storage volume 1 and the indirect heat exchanger 2), with the help of a pump 7. This indirect heat exchanger may be of any type, for example a tube or plate heat exchanger. Low pressure water vapour, with a temperature of 110-120° C., may, for example, flow on the outside of the tubes, while the circulating mixture flows inside the tubes. Because of the indirect heating that the liquid mixture is subjected to, many of the substances leave the mixture in gas form, including methanol, volatile sulphur-containing substances, and normally turpentine. The part of the mixture that remains in liquid form flows down into the liquid phase in the lower part of the storage volume 1. The remaining above mentioned gaseous substances are collected together with the methanol in the steam bonnet 3 and removed from storage volume 1 via tube 6.

The aim of the previously disclosed part of the process is partly that all the ammonium in the introduced raw material should be converted to an ammonium salt in dissolved form, and this may be accomplished by an almost instantaneous reaction between the ammonium and the acid, and partly that the mixture is allowed to circulate so many times in the disclosed "loop" that an optimal amount of methanol and volatile sulphur-containing substances are expelled in gas form. Regarding the temperature of the liquid in the storage volume 1, this will stabilise naturally at about 70-105° C. when sulphuric acid is used as the acidifier and when the concentration of ammonium salt is maintained at just below the precipitation point of the ammonium salt. Said temperature is dependent on how the streams are controlled and primarily on how the valve (not shown in the figure) in tube 10 is set, and naturally also on how much energy is supplied via the low pressure water vapour.

5-50%, and preferably 10-40%, of the ammonium salt-containing mixture flowing through tube 8, is withdrawn into tube 10 when the process has reached stable operating conditions, and the concentration of ammonium salt is maintained at 1-20%, and preferably 1-10%, below the concentration where ammonium salt is precipitated. The mixture withdrawn into tube 10 is transferred to the collection vessel 11. The amount of liquid withdrawn via tube 10 is controlled by a valve in tube 10. The liquid transferred to the container 11 not only contains water and the ammonium salt dissolved in it, but also contains a certain amount of the remaining methanol and a small amount of the above mentioned volatile sulphur-containing substances in dissolved form.

The water solution is made to circulate with a pump 12, from the container 11, via tubes 13 and 14, back to the container 11. This activity expels at least 80% of the methanol in the liquid and the methanol collects in gas form in the top part of the container 11. In addition the said sulphur-containing substances are expelled almost completely, and these also collect in gas form in the top part of the container 11. Said gas mixture is led via tube 15 to the rich gas tube 16. The purified ammonium salt in the form of a water solution is withdrawn via tube 17. Withdrawal in this case is also controlled by a valve in tube 17.

At the start of the method of purification according to the invention there is no liquid present inside the storage volume 1 until the two fluid streams 4 and 5 are introduced and mixed with each other. Once the method is in operation there is already a liquid containing ammonium salt in the storage volume 1, and this liquid is therefore mixed with the two material streams 4 and 5 when these are introduced to the storage volume 1. When the system is in equilibrium the amount of liquid supplied via tubes 4 and 5 is equal to the amount of liquid being withdrawn via tube 17 plus the amount of methanol, calculated into liquid form, that is being led away via tube 6. By controlling the amount of raw material per unit of time that is supplied via tube 4, and the thereof partly dependent amount of final product withdrawn per unit of time via tube 17, it is possible to control the circulation in said first "loop".

The gaseous substances being led away from storage volume 1 via tube 6 are introduced into the condenser 18. Cold water (not shown in the figure), is supplied to this condenser and heated water leaves the condenser (not shown in the figure). The incoming gases are cooled to a selected temperature within the range of 40-50° C. All gaseous methanol, which has a boiling point of 65° C., and any gaseous turpentine present will thereby condense to liquid form, while the remaining substances remain in gas form, except for a certain smaller amount of these substances that have dissolved in the liquid methanol. The gaseous substances are removed at the top of the condenser 18, via the rich gas tube 16. This tube has been given this name because of the concentration of substances is high in the gas phase and because these gases have a strong odour, i.e. are malodorous. These gases can not be let out into the atmosphere but are preferably transferred to a destruction facility of any known kind. If these gases may be used in the production of some useful chemical, this is an added benefit.

The liquid methanol with its content of malodorous, sulphur-containing substances and, in the normal case, turpentine, is led via tube 19 to the reactor 20. There an oxidizing agent is supplied via tube 21, for example in the form of a hydrogen peroxide solution. The temperature of the liquid, i.e. mainly methanol, in the reactor 20 is dependent on at which temperature the condensation of the methanol occurs in the condenser 18. If the temperature of the liquid in the condenser 18 is within the range of 40-50° C. then the temperature of the liquid being introduced to the reactor 20 is also 40-50° C. When the sulphur-containing substances dissolved in the methanol react with the hydrogen peroxide these substances are oxidized. The reactions are exothermic which results in an increase in the temperature of the liquid. This increase in temperature is counteracted in a way which will be disclosed hereafter.

Upon oxidation, the malodorous substances methane thiol, dimethyl sulphide and dimethyl disulphide are converted to the odourless substances methyl sulphonic acid, dimethyl sulphoxide and dimethyl sulphone. More specifically, the methane thiol as well as the dimethyl disulphide are converted to methyl sulphonic acid and dimethyl sulphide is converted to dimethyl sulphoxide and dimethyl sulphone.

The treated methanol is led onwards, with the help of the pump 22, through the tubes 23 and 24. A part of this methanol stream is withdrawn via a spur tube 25 and led to a cooler 26 and the cooled fluid stream is led via tube 27 back to the reactor 20, to counteract the increase in temperature caused by the exothermic oxidation reactions in this reactor. Cold water is used as a coolant even in this cooler 26, and the cold water is supplied via a tube (not shown in the figure), while the heated water is led away via another tube (not shown in the figure). A small amount of gases, including oxygen gas, collect in the top of the reactor 20 and these are led away via tube 28 out into the atmosphere.

The methanol is led via tube 24 to a separation vessel 29 to remove any turpentine and the liquid is made to, for example, flow over an overflow pipe in the decanter 29 and, because turpentine has a lower density than methanol, turpentine flows to the top of the decanter 29 and the completely purified methanol flows to the bottom of the decanter 29 and is withdrawn via tube 30 to be collected in the collection vessel 31. Recovered turpentine is led away from the top of the decanter 29 via tube 32 and the completely purified methanol, which is one of the two marketable chemicals, is withdrawn via tube 33.

FIG. 1 also shows a pump 34 and a spur tube 35. This arrangement makes it possible to let a part of the methanol circulate. It is not necessary to do this, it is only advisable. In the top of the decanter 29 as well as in the top of the collection vessel 31 small amounts of gases gather and these are led away via tubes 36 and 37 and meet in tube 38, which is connected to tube 28, which opens into the atmosphere.

FIG. 1 does not show a destruction step for the remaining peroxide and/or any organic peroxide formed in the methanol after it has left the reactor 20. It is probably necessary, from a safety aspect, to destroy any remaining peroxide. This may easily be done by adding a small amount of iron salt dissolved in water to the methanol. Upon addition of this chemical, or a chemical with similar properties, the peroxide is converted to harmless oxygen gas. This treatment step may be incorporated before or after the withdrawal step.

Example 1

This example describes how the first step in the method according to the invention, i.e. recovery of a highly purified ammonium salt, was simulated in the laboratory.

The experiments were carried out in a distilling apparatus comprised of a three necked flask, a Liebig cooler and a thermometer. The three necked flask was placed in a water bath with a magnetic stirrer.

Two types of raw material were used, a methanol/water mixture derived from water vapour stripping of contaminated condensate in a sulphate pulp mill, and a synthetic methanol/water mixture, whose contents were added and mixed together at the laboratory. The pH value of both raw materials was 9.5.

The two types of raw material were treated in the same way. 500 ml of the raw material was poured into the three necked flask. The liquid was heated to 40° C. whereafter a water solution of sulphuric acid (50 percent by weight) was added. The amount of sulphuric acid needed was calculated from the amount of ammonia in the liquid plus a surplus of 5%. When the sulphuric acid solution was added, ammonia ($NH_3$) was converted to the ammonium ion ($NH_{4^+}$) and this in turn formed, together with the added sulphate ion ($SO_4^{2-}$), ammonium sulphate ($(NO_4)_2SO_4$). The amount of ammonium sulphate formed increased when the addition of sulphuric acid ($H_2SO_4$) increased. A part of the salt was dissolved in the water present, but, because the amount of water was initially low, the water was saturated with salt fairly quickly, leading to a precipitation of salt, i.e. a precipitation of ammonium sulphate crystals. Gas was emitted during the disclosed reaction. The temperature of the mixture rapidly increased to 70° C., which is above the boiling point of methanol but below the boiling point of the acid and water. As the methanol was distilled off in gas form, the proportion of water increased in the remaining liquid mixture, which led to the precipitated ammonium sulphate gradually dissolving. The phase described thus far is called the start-up phase.

When all of the precipitated ammonium sulphate had been dissolved, the experiment reached its stationary phase. At this point the amount of water in the liquid was high enough for all of the ammonium sulphate to be dissolved. The solubility of ammonium sulphate is about 850 g/l at a temperature of 70° C. During this stationary phase, more raw material and sulphuric acid was added at such a rate that no precipitation of ammonium sulphate occurred. A suitable lowest concentration of ammonium sulphate for the formation of a polar solution that reduces the solubility of the methanol, is 680-765 g/l, i.e. 20-10% below the maximum solubility of 850 g/l. Ideally the concentration should be just below the maximum solubility, but for operability and the establishment of a margin in relation to precipitation, a concentration is chosen depending on the response of the controlling system to ensure that a precipitate is not formed.

If the liquid becomes cloudy it is a sign that the ammonium sulphate is being precipitated and this fact may be used to control the process via a feedback system, either by detecting the cloudiness of the liquid with optical sensors, or by measuring conductivity, or in the simplest form, by visually monitoring the liquid through a sight glass and increasing the net inflow of water and/or the expulsion of methanol.

During this stationary phase the pH value was maintained within the range of 2-4. When the liquid in the flask reached a certain level, some of the liquid was removed. On the surface of this water solution there was a very thin layer of turpentine. This could easily be removed by stirring with moderate heating. During the stationary phase mainly methanol was expelled in gaseous form. This gas phase was cooled to a temperature of 30° C. and the methanol was collected in liquid form in a vessel. This liquid will henceforth be called output methanol. Remaining gases that could not be condensed were allowed to flow to a fume hood.

The amounts of a number of important chemicals in the input raw material and in the output methanol are shown below. In all of the following tables the abbreviations MT, DMS and DMDS are methane thiol, dimethyl sulphide and dimethyl disulphide, respectively. In table 1 below, the input raw material is a methanol/water mixture produced at the laboratory and in table 2 the raw material is a methanol/water mixture from the sulphate pulp mill.

TABLE 1

| Sample | Ammonia/ Ammonium g/l | MT g/l | DMS g/l | DMDS g/l | Turpentine g/l |
|---|---|---|---|---|---|
| Input raw material | 33 | 20 | 29 | 28 | 12 |
| Output methanol | 0.3 | 0.6 | 0.35 | 6.8 | 2.5 |

TABLE 2

| Sample | Ammonia/Ammonium g/l | MT g/l | DMS g/l | DMDS g/l | Turpentine g/l |
|---|---|---|---|---|---|
| Input raw material | 12 | 4.3 | 9.4 | 0 | 8 |
| Output methanol | 0.6 | 0.12 | 1.1 | 0 | 1.4 |

The large difference in the amount of chemicals between the two raw materials is due to the following reasons.

In the synthetic raw material, i.e. that which has been produced at the laboratory, concentrations of chemicals that are normal in industrial raw materials were chosen as a starting point. The authentic raw material, i.e. that which was obtained at a specific time from a sulphate pulp mill, was shown to be unusually pure, i.e. chemically poor. It was shown, for example, that no DMDS was present in this raw material, which is very unusual.

The results show that only very little of the chemicals in the input raw material, which are mainly to be regarded as contaminants, accompany the methanol from step 1.

The most important aspect in this context is evident in table 3 below, where the purity of the output ammonium sulphate solution from the stationary phase is shown.

TABLE 3

| Sample | Ammonia/ Ammonium g/l | MT g/l | DMS g/l | DMDS g/l | Turpentine g/l |
|---|---|---|---|---|---|
| Ammonium sulphate solution | 110 | <0.001 | <0.003 | 0.01 | 0.02 |

As is evident, the purity of the recovered ammonium sulphate is very high.

Example 2

This example describes how the second step in the method according to the invention, i.e. recovery of a highly purified methanol, was simulated in the laboratory.

Methanol, which has been recovered during the stationary phase from both the synthetic and authentic raw material, was used in these experiments.

To 100 ml methanol in a glass flask, 10 ml hydrogen peroxide (30 percent by weight) was added first, followed by 500 µl iron (III) chloride solution with a concentration of 10 percent by weight. The temperature of the methanol was 25° C. and the total treatment time was 3 minutes. The hydrogen peroxide reacted with the malodorous MT, DMS and DMDS to form the odourless substances methyl sulphonic acid, dimethyl sulphoxide and dimethyl sulphone. The iron chloride solution was added, for safety reasons, to destroy any remaining peroxide after the oxidation treatment.

The purity of the treated methanol is shown in table 4 below.

TABLE 4

| Sample | Ammonium g/l | MT mg/l | DMS mg/l | DMDS mg/l | Turpentine mg/l |
|---|---|---|---|---|---|
| Synthetic methanol | 0.3 | <1 | <0.1 | <0.1 | 210 |
| Authentic methanol | 0.5 | <1 | <0.1 | 0 | 320 |

It was not possible to detect any remaining malodorous sulphur-containing chemicals in the treated methanol. A negligible amount of both ammonium sulphate and turpentine remained in the treated methanol.

While the present invention has been described in accordance with preferred compositions and embodiments, it is to be understood that certain substitutions and alterations may be made thereto without departing from the spirit and scope of the following claims.

The invention claimed is:

1. A method for extracting a purified ammonium salt and purified methanol from a secondary condensate comprising:

subjecting a contaminated primary condensate to stripping in a stripper, expelling stripper gases from the stripper, the stripper gases containing methanol, water, volatile sulphur-containing substances and ammonia, condensing the stripper gases and forming a secondary condensate, conveying the secondary condensate to a storage volume, adding an acid to the secondary condensate in the storage volume, acidifying the secondary condensate with the acid, the acid forming an ammonium salt with the ammonium contained in the secondary condensate, a net inflow of water via the secondary condensate and the addition of acid maintaining a concentration of ammonium salt in the storage volume at 1-20% below a level at which the ammonium salt is precipitated, withdrawing an ammonium-salt containing mixture from the storage volume, withdrawing 5-50% of the ammonium-salt containing mixture withdrawn from the storage volume into a collection-vessel tube and conveying to a collection-vessel to form a collection vessel mixture, stirring and/or circulating the collection-vessel mixture in the collection-vessel with a high-water content and expelling methanol and volatile sulphur-containing substances in gas form from the storage volume, transferring the expelled methanol and volatile sulphur-containing substances to a condenser, condensing the expelled methanol in the condenser while the volatile sulphur-containing substances remain in gas form, conveying the condensed methanol to a reactor, removing the volatile sulphur-containing substances in gas form from the condenser, adding an oxidizing agent to the condensed methanol in the reactor, converting remaining liquid soluble malodorous sulphur-containing substances in the condensed methanol to mainly odorless substances, and circulating a mixture of methanol and oxidizing agent in the reactor while cooling the mixture of methanol and oxidizing agent in an indirect heat exchanger.

2. A method according to claim 1, wherein the secondary condensate is derived from a contaminated primary condensate that has been produced during a production of sulphate pulp.

3. A method according to claim 1 wherein the acidification being performed with the acid is of such strength and in such an amount that a pH value of a water phase in the mixture is within a range of 2-6.5.

4. A method according to claim 3, wherein the acidification is performed with a sulphuric acid resulting in a formation of ammonium sulphate.

5. A method according to claim 1, wherein the gases that are removed from the condenser are transferred to a destruction facility.

6. A method according to claim 1 wherein the method further comprises the steps of expelling gases of the methanol and volatile sulphur contain substances from the ammonium salt collected in a container and either transferring the gases directly to a destruction facility, or after being mixed with the gases, removing the gases from the condenser.

7. A method according to claim 1, wherein the oxidizing agent is a peroxide.

8. A method according to claim 7, wherein the peroxide is hydrogen peroxide.

9. A method according to claim 1 wherein the methanol, after an oxidation treatment is passed through a decanter to remove any remaining turpentine, before transferring the methanol to a storage tank.

10. A method according to claim 7 wherein a chemical that destroys any remaining peroxide in the methanol is added to the oxidation treated methanol.

11. A method according to claim 10, wherein the chemical is an iron salt.

12. A method according to claim 1 wherein the re-circulation is at least 2-15 fold that of an inflow of the secondary condensate into the storage volume.

13. A method for extracting methanol and ammonium salt from an ammonia/ammonium-containing methanol/water primary condensate derived from a digestion house during a delignification of lignocellulose material to cellulose pulp with an alkaline cooking liquor, and/or from evaporation of cooking waste liquor, comprising:

stripping the primary condensate forming a secondary condensate from the stripping, acidifying the secondary condensate with an acid having an ability to form an ammonium salt with the ammonium contained in the secondary condensate, storing a mixture of the secondary condensate and the acid in a storage volume, heating the mixture of the secondary condensate and the acid contained in the storage volume to a temperature above the boiling point of methanol contained in the mixture but below a boiling point of both the acid and water, and circulating the heated mixture back to the storage volume forming a re-circulation flow, expelling methanol and volatile sulphur-containing substances in gas form from the storage volume such that a proportion of water in the re-circulated mixture increases compared to a proportion of water in the secondary condensate, establishing a net inflow of water via the secondary condensate and the addition of acid maintaining a concentration of ammonium salt in the storage volume at 1-20% below a level at which ammonium salt is precipitated, and withdrawing a part of the circulating mixture containing ammonium salt from the re-circulation flow.

14. The method according to claim 13 wherein the proportion of water in the re-circulated mixture increase by at least 2-5 fold compared to a proportion of water in the incoming secondary condensate.

15. The method according to claim 13 wherein the re-circulation flow of the circulating mixture is at least 2-15 fold that of an inflow of the secondary condensate.

16. The method according to claim 13 wherein the heating of the mixture of the secondary condensate and the acid contained in the storage volume is done by passing the mixture through an indirect heat exchanger.

17. The method according to claim 13 wherein the heating the temperature is within a range of 70-105° C.

18. The method according to claim 13 wherein 5-50% of the circulating mixture containing ammonium salt is withdrawn from the re-circulation flow from the mixture withdrawn from the storage volume and conveyed to a collection vessel.

19. The method according to claim 13 wherein the methanol and volatile sulphur-containing substances are transferred to a condenser, the method further comprising the steps of:

condensing the methanol while the volatile sulphur-containing substances remain in gas form, separately removing a liquid phase of the methanol and a gas phase of the volatile sulphur-containing substances from the condenser, conveying the methanol to a reactor, adding an oxidizing agent to the methanol in the reactor, and converting any remaining liquid soluble malodorous sulphur-containing substances in the methanol to mainly odorless substances.

20. The method according to claim 13 wherein the method further comprises the step of stirring and/or circulating the mixture in the collection vessel with a high water content to expel at least 80% of any remaining methanol and at least 95% of any remaining volatile sulphur-containing substances in the mixture conveyed to the collection vessel.

* * * * *